US011774088B2

(12) United States Patent
Andersson

(10) Patent No.: US 11,774,088 B2
(45) Date of Patent: Oct. 3, 2023

(54) METHOD FOR OPERATING A FLUIDIZED BED BOILER

(71) Applicant: Improbed AB, Malmo (SE)

(72) Inventor: Bengt-Ake Andersson, Molnlycke (SE)

(73) Assignee: IMPROBED AB

( * ) Notice: Subject to any disclaimer, the term of this patent is extended or adjusted under 35 U.S.C. 154(b) by 913 days.

(21) Appl. No.: 16/604,912

(22) PCT Filed: Apr. 18, 2018

(86) PCT No.: PCT/EP2018/000208
§ 371 (c)(1),
(2) Date: Oct. 11, 2019

(87) PCT Pub. No.: WO2018/192680
PCT Pub. Date: Oct. 25, 2018

(65) Prior Publication Data

US 2020/0292163 A1 Sep. 17, 2020

(30) Foreign Application Priority Data

Apr. 19, 2017 (EP) ..... 17167053

(51) Int. Cl.
*F22B 31/00* (2006.01)
*F23C 10/26* (2006.01)
(Continued)

(52) U.S. Cl.
CPC ..... *F22B 31/0015* (2013.01); *B03C 1/12* (2013.01); *B03C 1/30* (2013.01); *F22B 31/0092* (2013.01);
(Continued)

(58) Field of Classification Search
CPC .... F22B 31/0015; F22B 31/0092; B03C 1/12; B03C 1/30; B03C 2201/18; B03C 1/14;
(Continued)

(56) References Cited

U.S. PATENT DOCUMENTS 2,065,460 A 12/1936 Johnson
2,750,903 A * 6/1956 Miller ..... F23C 99/00 110/165 A
(Continued)

FOREIGN PATENT DOCUMENTS

CN 101326125 12/2008
CN 203899735 U * 10/2014
(Continued)

OTHER PUBLICATIONS

International Search Report and Written Opinion, Int'l Patent Application No. PCT/EP2018/000208, dated Jul. 12, 2018, 13 pages.

*Primary Examiner* — Gene O Crawford
*Assistant Examiner* — Muhammad Awais
(74) *Attorney, Agent, or Firm* — CASIMIR JONES, SC; Brian F. Bradley

(57) ABSTRACT

The invention relates to a method for operating a fluidized bed boiler (6), comprising the steps of: a) providing fresh ilmenite particles having a shape factor of 0.8 or lower as bed material to the fluidized bed boiler (6); b) carrying out a fluidized bed combustion process; c) removing at least one ash stream comprising ilmenite particles from the fluidized bed boiler; d) separating ilmenite particles from the at least one ash stream, wherein the separation includes a step of using a magnetic separator (12) comprising a field strength of 2,000 Gauss or more; e) recirculating separated ilmenite particles into the bed of the fluidized bed boiler; wherein the average residence time of ilmenite particles in the fluidized bed is 100 h or more.

21 Claims, 5 Drawing Sheets

Figure 1:
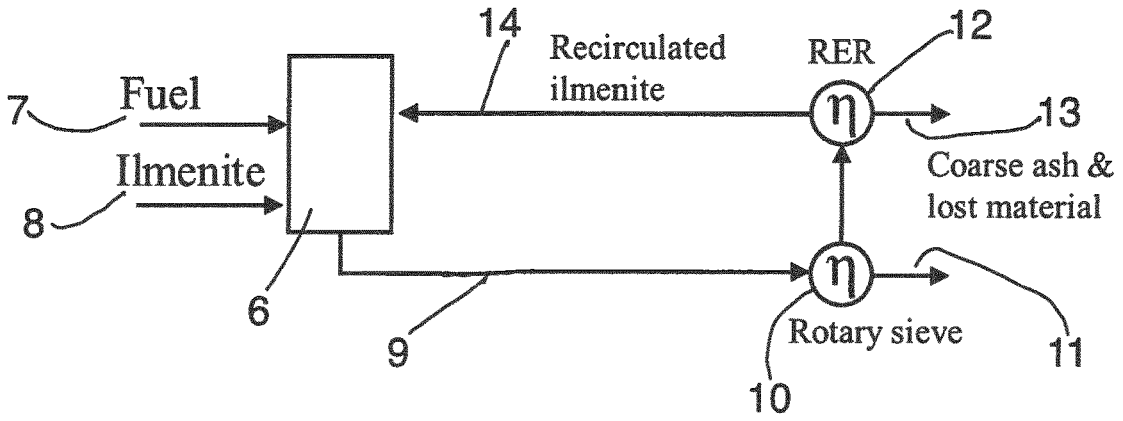

(51) Int. Cl.

| | |
|---|---|
| ***B03C 1/12*** | (2006.01) |
| ***B03C 1/30*** | (2006.01) |
| ***F23C 10/01*** | (2006.01) |
| ***F23C 10/02*** | (2006.01) |
| ***F23G 5/30*** | (2006.01) |

(52) U.S. Cl.
CPC ..... *F23C 10/01* (2013.01); *F23C 10/02* (2013.01); *F23C 10/26* (2013.01); *F23G 5/30* (2013.01); *B03C 2201/18* (2013.01); *F23C 2900/10001* (2013.01); *F23J 2700/001* (2013.01); *F23J 2900/01001* (2013.01); *F23J 2900/15023* (2013.01)

(58) Field of Classification Search
CPC ..... F23C 10/01; F23C 10/02; F23C 10/26; F23C 2900/10001; F23G 5/30; F23J 2700/001; F23J 2900/01001; F23J 2900/15023
USPC ..... 122/4 D
See application file for complete search history.

(56) References Cited

U.S. PATENT DOCUMENTS

| | | | | |
|---|---|---|---|---|
| 3,045,822 | A * | 7/1962 | Cavanagh | B03C 1/12 209/231 |
| 3,935,094 | A * | 1/1976 | Bergeron | B03C 1/00 209/214 |
| 10,871,286 | B2 | 12/2020 | Andersson et al. | |
| 2008/0286181 | A1* | 11/2008 | Freitas | C22B 34/1209 423/80 |

FOREIGN PATENT DOCUMENTS

| | | | | |
|---|---|---|---|---|
| CN | 107002989 | | 8/2017 | |
| EP | 2515038 | | 10/2012 | |
| EP | 3037724 | | 6/2016 | |
| EP | 3037724 | A1 * | 6/2016 | F23C 10/10 |
| EP | 3153775 | | 4/2017 | |
| EP | 3153775 | A1 * | 4/2017 | C22B 34/1204 |

* cited by examiner

METHOD FOR OPERATING A FLUIDIZED BED BOILER

The invention relates to a method for operating a fluidized bed boiler in the context of a bed management cycle for a fluidized bed boiler, such as a circulating fluidized bed boiler or a bubbling fluidized bed boiler.

Fluidized bed combustion is a well-known technique, wherein the fuel is suspended in a hot fluidized bed of solid particulate material, typically silica sand and/or fuel ash. Other bed materials are also possible. In this technique, a fluidizing gas is passed with a specific fluidization velocity through a solid particulate bed material. The bed material serves as a mass and heat carrier to promote rapid mass and heat transfer. At very low gas velocities the bed remains static. Once the velocity of the fluidization gas rises above the minimum fluidization velocity, at which the force of the fluidization gas balances the gravity force acting on the particles, the solid bed material behaves in many ways similarly to a fluid and the bed is said to be fluidized. In bubbling fluidized bed (BFB) boilers, the fluidization gas is passed through the bed material to form bubbles in the bed, facilitating the transport of the gas through the bed material and allowing for a better control of the combustion conditions (better temperature and mixing control) when compared with grate combustion. In circulating fluidized bed (CFB) boilers the fluidization gas is passed through the bed material at a fluidization velocity where the majority of the particles are carried away by the fluidization gas stream. The particles are then separated from the gas stream, e.g., by means of a cyclone, and recirculated back into the furnace, usually via a loop seal. Usually oxygen containing gas, typically air or a mixture of air and recirculated flue gas, is used as the fluidizing gas (so called primary oxygen containing gas or primary air) and passed from below the bed, or from a lower part of the bed, through the bed material, thereby acting as a source of oxygen required for combustion. A fraction of the bed material fed to the combustor escapes from the boiler with the various ash streams leaving the boiler, in particular with the bottom ash. Removal of bottom ash, i.e. ash in the bed bottom, is generally a continuous process, which is carried out to remove alkali metals (Na, K) and coarse inorganic particles/lumps from the bed and any agglomerates formed during boiler operation, and to keep the differential pressure over the bed sufficient. In a typical bed management cycle, bed material lost with the various ash streams is replenished with fresh bed material.

From the prior art it is known to replace a fraction or all of the silica sand bed material with ilmenite particles in the CFB process (H. Thunman et al., Fuel 113 (2013) 300-309). Ilmenite is a naturally occurring mineral which consists mainly of iron titanium oxide ($FeTiO_3$) and can be repeatedly oxidized and reduced. Due to the reducing/oxidizing feature of ilmenite, the material can be used as oxygen carrier in fluidized bed combustion. The combustion process can be carried out at lower air-to-fuel ratios with the bed comprising ilmenite particles as compared with non-active bed materials, e.g., 100 wt.-% of silica sand or fuel ash particles.

The problem underlying the invention is to provide an improved method or process as indicated above for ilmenite containing bed material.

The inventive method for operating a fluidized bed boiler comprises the steps of:

a) providing fresh ilmenite particles having a shape factor of 0.8 or lower as bed material to the fluidized bed boiler;
b) carrying out a fluidized bed combustion process;
c) removing at least one ash stream comprising ilmenite particles from the fluidized bed boiler;
d) separating ilmenite particles from the at least one ash stream, wherein the separation includes a step of using a magnetic separator comprising a field strength of 2,000 Gauss or more;
e) recirculating separated ilmenite particles into the bed of the fluidized bed boiler;
wherein the average residence time of ilmenite particles in the fluidized bed is 100 h or more.

First, several terms are explained in the context of the invention.

Fluidized bed boiler is a term well known in the art. The invention can be used in particular for bubbling fluidized bed (BFB) boilers, and circulating fluidized bed (CFB) boilers. CFB boilers are preferred.

The shape factor or sphericity of a particle is defined as the surface area of the particle divided by the surface area of a sphere of the same volume. Rock ilmenite particles described below have a sphericity (shape factor)<0.8. A typical sphericity value for rock ilmenite is about 0.7. In the context of the invention, a shape factor of 0.75 or lower is preferred.

The field strength of the magnetic separator is preferably determined on the surface of the transport means for the bed material undergoing magnetic separation.

In the context of the invention, the average residence time of the ilmenite particles in the boiler ($T_{Res,ilmenite}$) is defined as the ratio of the total mass of ilmenite in the bed inventory ($M_{ilmenite}$) to the product of the feeding rate of fresh ilmenite ($R_{feed,ilmenite}$) with the production rate of the boiler ($R_{Production}$):

$$T_{Res,ilmenite}=M_{ilmenite}/(R_{feed,ilmenite}\times R_{Production})$$

By way of example, if the total mass of ilmenite in the boiler is 25 tons, the feeding rate of fresh ilmenite is 3 kg/MWh and the production rate is 75 MW, this gives the average residence time $T_{Res,ilmenite}=25/(3\times75/1000)$ h=111 h. Recirculation of separated ilmenite particles is a convenient way of extending the average residence time of the ilmenite particles in the boiler since the feeding rate for fresh ilmenite can be reduced.

The invention has recognized that ilmenite particles can be conveniently separated from the boiler ash using magnetic separation as defined in the claims and that even after extended use as bed material in a fluidized bed boiler ilmenite having the defined shape factor still shows very good oxygen-carrying properties and reactivity towards oxidizing carbon monoxide (CO) into carbon dioxide ($CO_2$), so called "gas conversion" and good mechanical strength. In particular, the invention has recognized that the attrition rate of the ilmenite particles surprisingly decreases after an extended residence time in the boiler and that the mechanical strength is still very good after the ilmenite has been utilized as bed material for an extended period of time. This was surprising, since ilmenite particles, after having experienced an initial activation phase, undergo chemical aging as they are subjected to repeated redox-conditions during combustion in fluidized bed boilers and the physical interactions with the boiler structures induce mechanical wear on the ilmenite particles. It was therefore expected that the oxygen-carrying capacity of ilmenite particles and their attrition resistance rapidly deteriorate during the combustion process in a fluidized bed boiler.

The invention has recognized that in light of the good attrition resistance the surprisingly good oxygen-carrying properties of used ilmenite particles can be exploited by recirculating the separated ilmenite particles into the boiler bed. This reduces the need to feed fresh ilmenite to the boiler which in turn significantly reduces the overall consumption of the natural resource ilmenite and makes the combustion process more environmentally friendly and more economical. In addition, the separation of ilmenite from the ash and recirculation into the boiler allows for the control of the ilmenite concentration in the bed and eases operation. Furthermore, the inventive bed management cycle further increases the fuel flexibility by allowing to decouple the feeding rate of fresh ilmenite from the ash removal rate, in particular the bottom ash removal rate. Thus changes in the amount of ash within the fuel become less prominent since a higher bottom bed regeneration rate can be applied without the loss of ilmenite from the system.

The fresh ilmenite particles are preferably rock ilmenite

Hard rock or massive ilmenite is available in igneous rock deposits, e.g. in Canada, Norway and China. The content of TiO2 in rock ilmenite is rather low (typically 30-50 mass-%) but its iron content is relatively high (typically 30-50 mass-%). The rock ilmenite is mined and upgraded via crushing and separation from impurities. This yields that the sphericity of rock ilmenite is lower than e.g. natural silica sand. The shape factor of Norwegian rock ilmenite (provided by Titania A/S) is around 0.7.

Ilmenite sand (not preferred according to the invention) can be found in placer deposits of heavy minerals occurring for example in South Africa, Australia, North America and Asia. Generally, sand ilmenites stem from weathered rock deposits. The weathering causes the iron content to decrease while increasing the concentration of TiO2. Due to the natural iron oxidation and dissolution, hence also called altered ilmenite, the TiO2 content can be as high as 90 wt. %. The shape factor of sand ilmenites typically is in the range 0.8-1 with a mean factor value of around 0.9.

Preferably the fresh ilmenite particles comprise a particle size distribution with a maximum at 100 to 400, further preferred 150 to 300 μm.

To determine particle size distribution, sieving with an appropriate sequence of mesh sizes is used. Sieving plates of the following mesh size may be used: 355 μm, 250 μm, 180 μm, 125 μm, 90 μm and a bottom plate for fractions below 90 μm.

Preferably, the at least one ash stream is selected from the group consisting of bottom ash stream and fly ash stream. Most preferably the at least one ash stream is a bottom ash stream. In advantageous embodiments of the inventive bed management cycle, any combination of two or more ash streams is possible. Bottom ash is one of the major causes for the loss of bed material in fluidized bed boilers and in a particularly preferred embodiment the at least one ash stream is a bottom ash stream. Fly ash is that part of the ash, which is entrained from the fluidized bed by the gas and flies out from the furnace with the gas.

Preferably, the method further comprises a pre-classification step, in which the particles in the at least one ash stream are pre-classified before magnetic separation of the ilmenite particles from the ash stream; wherein preferably the pre-classification comprises mechanical particle classification and/or fluid driven particle classification, more preferably sieving and/or gas driven particle classification. In fluid driven particle separation the particles are separated based on their fluid-dynamic behavior. A particularly preferred variant for fluid driven separation comprises gas driven particle separation.

Preferably, the mechanical particle classification comprises sieving with a mesh size from 200 to 1,000 μm, preferably 300 to 800 μm, further preferred 400 to 600 μm.

The invention has found out that the majority of ilmenite in the bottom ash comprises a particle size of 500 μm or lower so that the mechanical classifier provides a fine particle size fraction having a more homogenous size distribution while still comprising the majority of the ilmenite particles. The magnetic separation in the second step can be carried out more efficiently.

The initial mechanical classification in particular serves three purposes. First, it contributes to protect the magnetic separator from large ferromagnetic objects such as nails which could otherwise damage the magnetic separator or its parts. Second, it reduces the load on the magnetic separator by reducing the mass flow. Third, it enables simpler operation of the magnetic separator as it generates a narrower particle size distribution.

In a particularly preferred embodiment the mechanical classifier comprises a rotary sieve which has been found effective to pre-classify the bottom ash to remove coarse particles.

In one embodiment of the invention the mechanical classifier further comprises a primary sieve prior to the mechanical classifier having the mesh size as defined above (e.g. the rotary sieve) to separate coarse particles having a particle size of 2 cm or greater, e.g. coarse particle agglomerates of golf ball size.

The method may comprise a step for separating elongate ferromagnetic objects from the ash stream prior to the magnetic separator. The mechanical classifier can comprise a slot mesh to remove small pieces of thin metal wire or nails that tend to plug mesh holes and also affect the magnetic separation in the subsequent step.

The magnetic separator comprises a field intensity of 2,000 Gauss or more, preferably 4,500 Gauss or more on the surface of the transport means of the bed material. This has been found effective to separate ilmenite from ash and other nonmagnetic particles in the particle stream.

Preferably the magnetic separator comprises a rare earth roll (RER) or rare earth drum (RED) magnet. Corresponding magnetic separators are known in the art per se and are e.g. available from Eriez Manufacturing Co. (www.eriez.com). Rare earth roll magnetic separators are high intensity, high gradient, permanent magnetic separators for the separation of magnetic and weakly magnetic iron-containing particles from dry products. The ash stream is transported on a belt which runs around a roll or drum comprising rare earth permanent magnets. While being transported around the roll ilmenite remains attracted to the belt whereas the nonmagnetic particle fraction falls off. A mechanical separator blade helps to separate these two particle fractions.

In one embodiment of the invention the magnetic field is axial, i.e. parallel to the rotational axis of the drum or roll. An axial magnetic field with the magnets having a fixed direction causes strongly magnetic material to tumble as it passes from north to south poles, releasing any entrapped nonmagnetic or paramagnetic materials.

In another embodiment of the invention the magnetic field is radial, i.e. comprising radial orientation relative to the rotational axis. Generally a radial orientation has the advantage of providing a higher recovery rate of all weakly magnetic material which can come at the cost of less purity due to entrapped nonmagnetic material.

It is also possible to use a two stage magnetic separation with a first step using axial orientation thereby helping to release entrapped nonmagnetic material and the second step using radial orientation to increase the recovery rate.

Preferably the average residence time of the ilmenite particles in the fluidized bed boiler is at least 120 h, further preferably at least 200 h, further preferably at least 300 h. Surprisingly, the invention has found that even after approx. 300 h of continuous operation in a fluidized bed boiler, ilmenite particles still show very good oxygen-carrying properties, gas conversion and mechanical strength, clearly indicating that even higher residence times are achievable.

In preferred embodiments, the average residence time of the ilmenite particles may be less than 600 h, further preferably less than 500 h, further preferably less than 400 h, further preferably less than 350 h. All combinations of stated lower and upper values for the average residence time are possible within the context of the invention and herewith explicitly disclosed.

Preferably, the boiler is a circulating fluidized bed boiler (CFB).

Preferably the separation efficiency of the method for ilmenite bed material is at least 0.5 by mass, preferably at least 0.7 by mass. That means that at least 50 or 70 wt. % of ilmenite comprised in the ash stream can be separated from the ash and recirculated into the boiler. In the context of the invention, the term wt. % is used as a synonym for mass.

The recirculation capacity and separation efficiency is also affected by the ash flow temperature where there is a tradeoff between the separation efficiency and the ash flow temperature. A higher temperature will decrease the efficiency of the magnetic separation and leads to the use of more expensive heat resistant materials in the system used to carry out the inventive method. By adopting measures for cooling the ash flow the negative effects on the separation efficiency and material requirements of high temperatures can be negated. The system can also be equipped with temperature sensors and ash flow splitters that will allow the flow to be redirected and bypassing the separation system in case of temporary high temperatures.

In the operation of the boiler, the fraction of ilmenite in the bed material can be kept at 25 wt. % or more, preferably 30 wt. % or more. In another embodiment of the invention, preferred ilmenite concentrations in the bed are between 10 wt. % and 95 wt %, more preferably between 50 wt.-% and 95 wt. %, more preferably between 75 wt.-% and 95 wt.-%.

Embodiments of the invention are now shown by way of example with reference to the figures.

Figure 2:
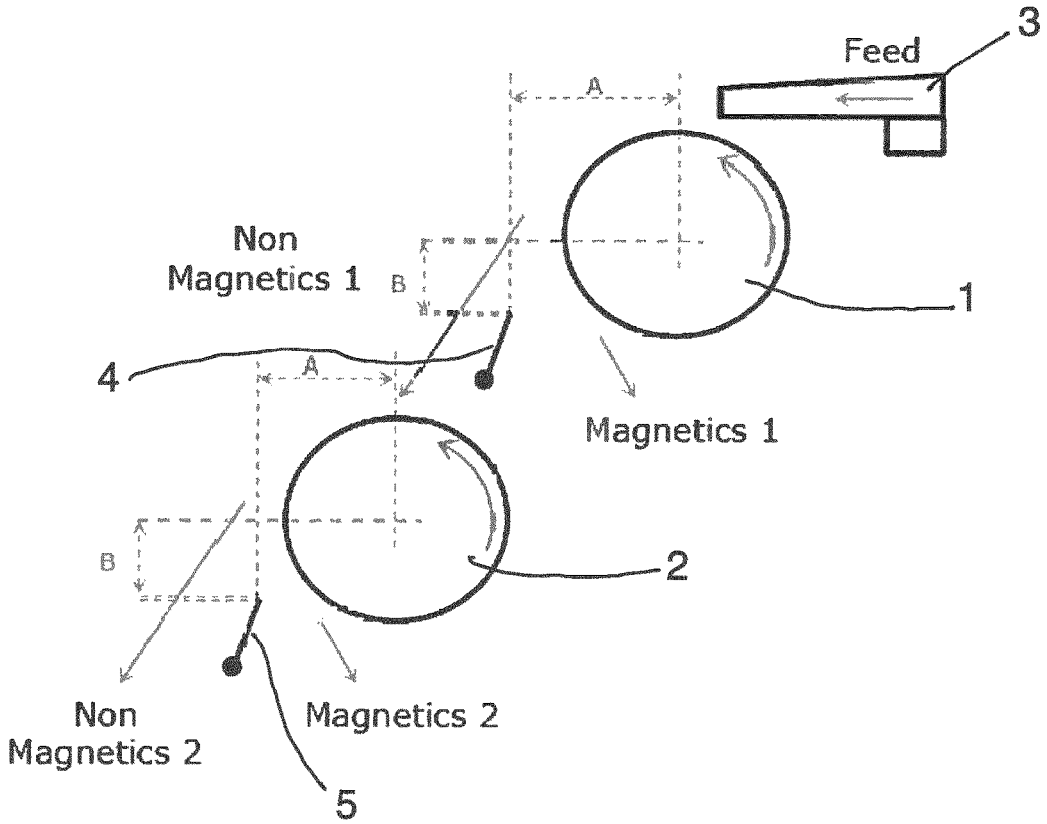
Figure 3:
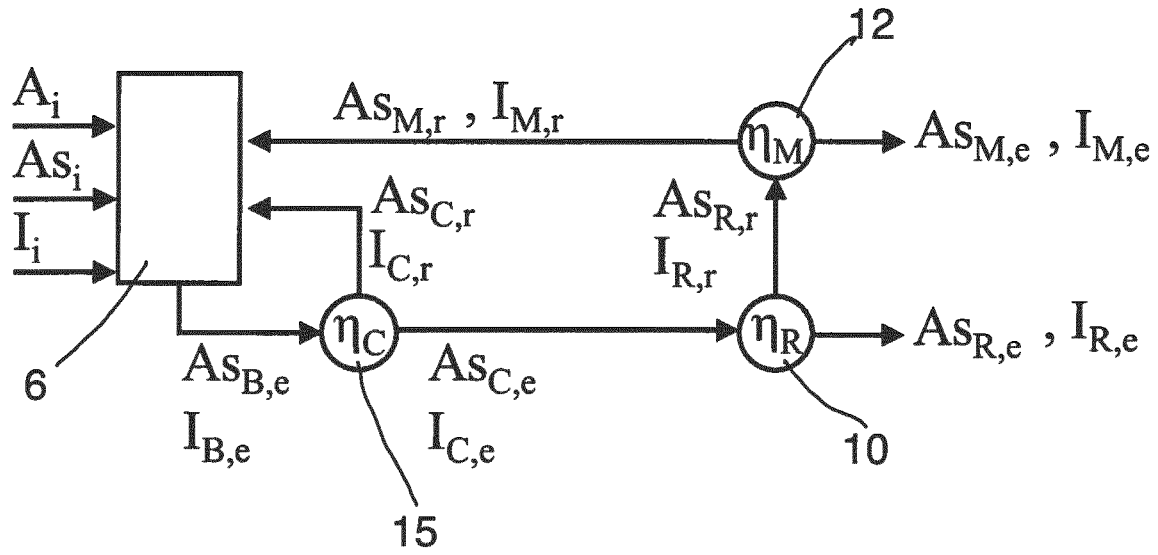
Figure 4:
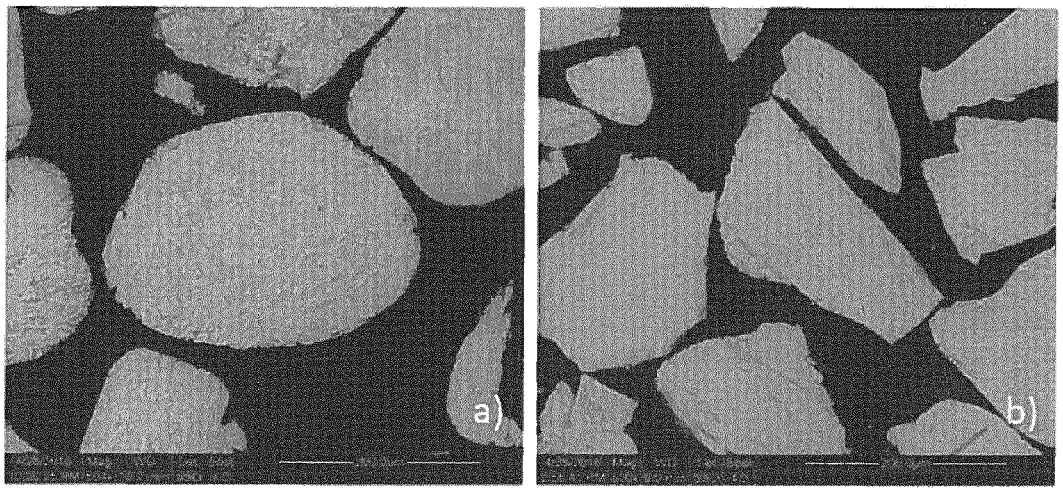
Figure 5:
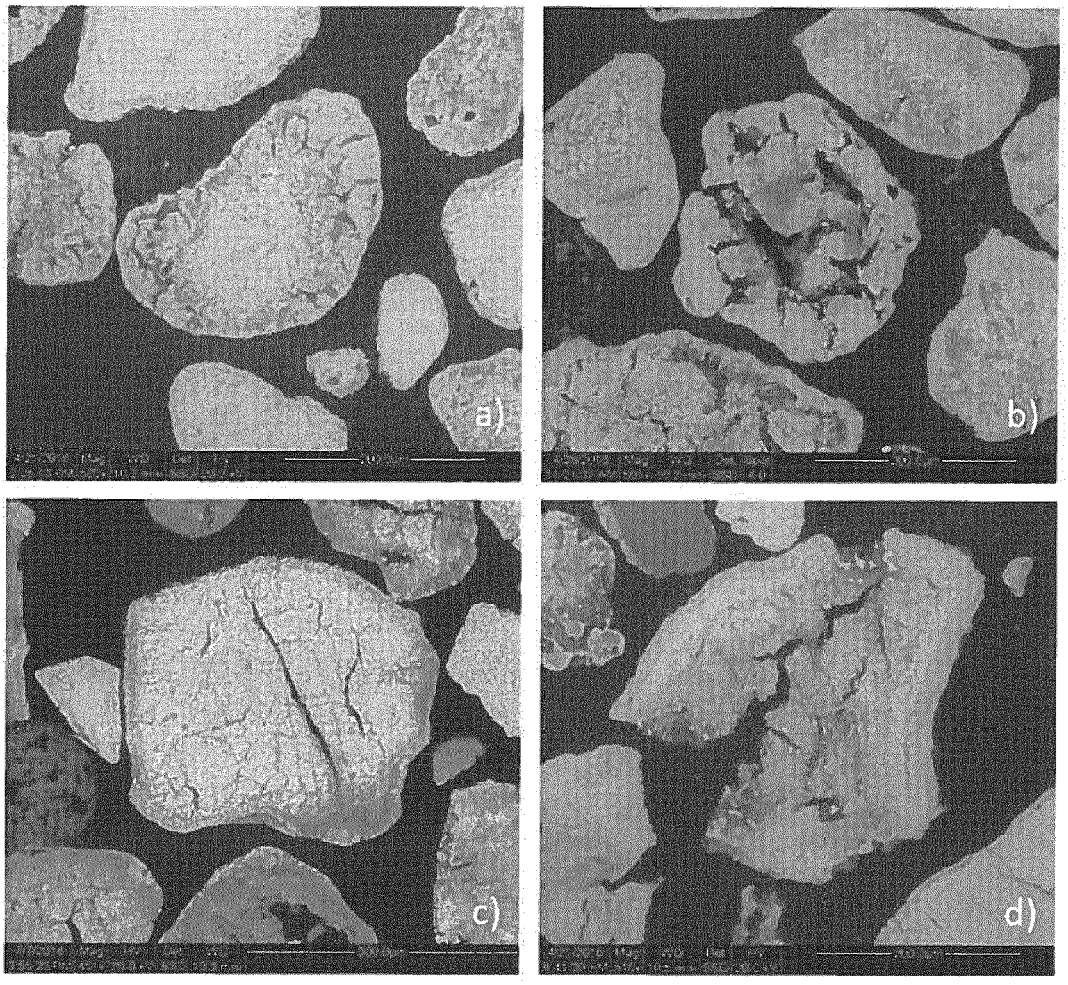
Figure 6:
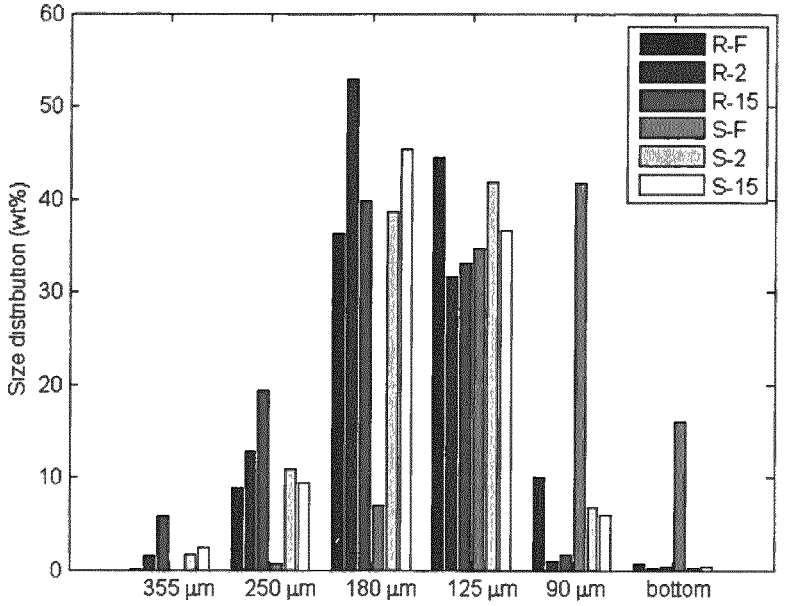
Figure 7:
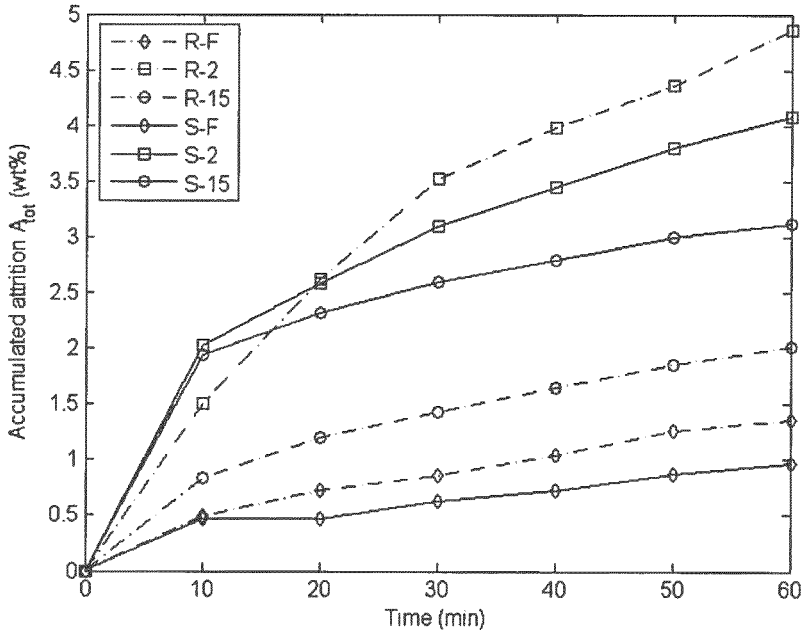
Figure 8:
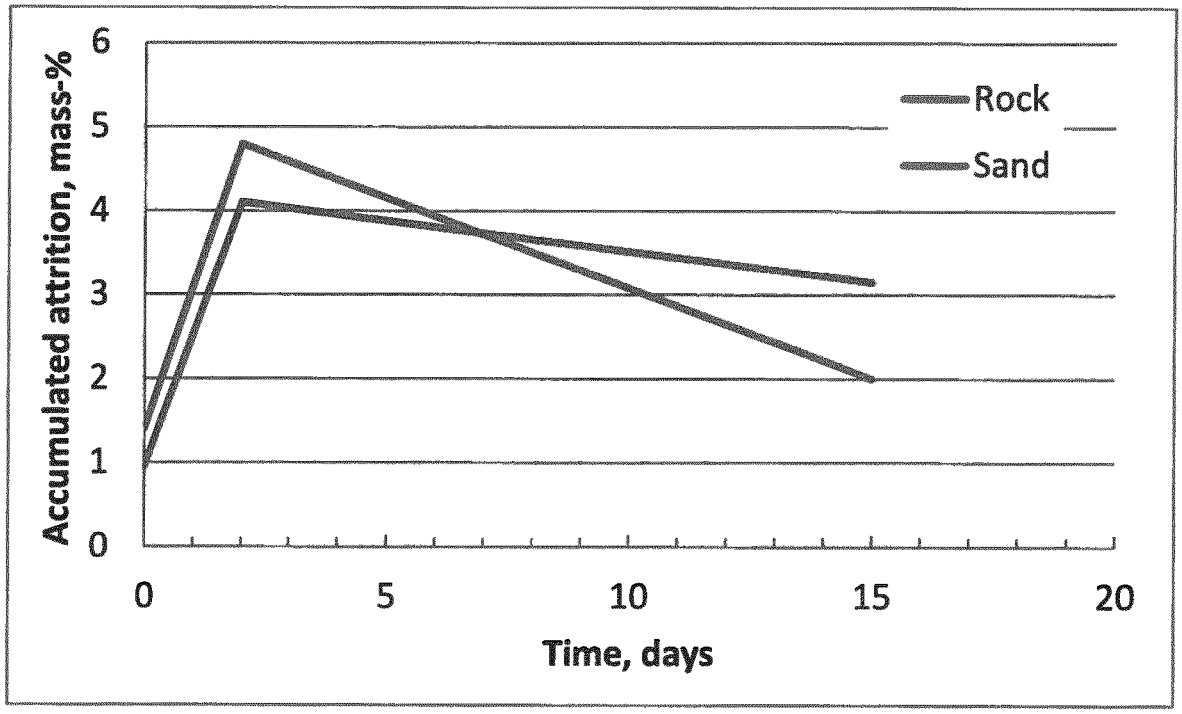

It is shown in:

FIG. 1: a schematic illustration of a system for practicing the invention;

FIG. 2: a schematic illustration of magnetic drum separator;

FIG. 3: a schematic illustration to show the mass streams in an embodiment of the process according to the invention;

FIG. 4: SEM micrographs of ilmenite particles used as bed material during the experiments: a) sand ilmenite; b) rock ilmenite;

FIG. 5: SEM micrographs of cross-section of ilmenite particles extracted after 2 and 15 days of exposure where a) and b) are sand ilmenite and c) and d) are rock ilmenite;

FIG. 6: sieving curves obtained through sieving of sand and rock ilmenite:

FIG. 7: accumulated attrition measured on sand and rock ilmenite;

FIG. 8: accumulated attrition plotted against time for rock-ilmenite and sand-ilmenite.

EXAMPLE 1

In this example the composition and particle size distribution of bottom ash is analyzed. The bottom ash was taken from a 75 MW municipal solid waste fired boiler operating with the bed material comprising silica sand and 16 wt. % rock ilmenite.

The bottom ash was sieved through a 500 μm mesh which removed the particle fraction coarser than 500 μm (about 50 wt. % of the original sample).

The bottom ash sample, excluding particulates coarser than 500 μm, of 8.3 kg was analyzed for ranges of material content of bed materials (ilmenite, silica oxide, calcium oxide, aluminum oxide) and particle size distribution.

Material Composition (Ranges, Wt. %):

| | |
|---|---|
| Ilmenite: | 10-20% |
| Silica oxide: | 40-60% |
| Calcium oxide: | 5-10% |
| Aluminum oxide: | 5-10% |

Particle Size Distribution (Wt. %):

| | |
|---|---|
| 355-500 μm: | ~7% |
| 250-355 μm | ~17% |
| 125-250 μm: | ~69% |
| <125 μm: | ~7% |

This analysis shows typical percentages of ilmenite in the bottom ash which can be retrieved according to the invention and also shows that the particle size distribution of the bottom ash does allow an initial mechanical classification to remove coarse particles with e.g. a mesh size of 500 μm.

EXAMPLE 2

In this example the effectiveness of magnetic separation processes is tested. The following test equipment was used:

Eriez® 305 mm dia.×305 mm wide model FA (Ferrite Axial) magnetic drum. Field strength ca. 2000 Gauss (drum #1).

Eriez® 305 mm dia.×305 mm wide model RA (Rare Earth Axial) magnetic drum. Field strength ca. 4500 Gauss (drum #2).

Eriez® 305 mm dia.×305 mm wide model RR (Rare Earth Radial) magnetic drum. Field strength ca. 4000 Gauss (drum #3).

FIG. 2 shows an arrangement of two magnetic separation drums or rolls in sequential order.

Material is fed through a feed 3 on a magnetic drum 1 rotating into the direction indicated by the arrow (counter-clockwise). Magnetic particles tend to adhere to the drum longer than nonmagnetic particles which is indicated by the arrows nonmagnetics 1 and magnetics 1 in the drawing. A mechanical separator blade 4 helps to separate the magnetic and nonmagnetic particle fractions.

When using a two-stage process, the nonmagnetic particle fraction from the first drum 1 can be fed to a second drum 2 for a second magnetic separation step.

Three tests were carried out, the first test using a two-step separation process and the second and third test using single step separation processes. The tests were carried out with bottom ash as analyzed in example 1.

Test 1

A 2.5 kg bottom ash sample was passed over a ferrite magnetic drum (drum #1) with an axial magnet arrangement. This causes the strongly magnetic material to tumble as it passes from north to south poles, releasing any entrapped nonmagnetic or paramagnetic materials, thus providing a cleaner magnetic fraction.

The nonmagnetic fraction from this first separation step was then passed over a second drum (drum #2), with a stronger Rare Earth axial magnetic field.

Test 2

A 1.25 kg bottom ash sample was passed over a drum (drum #2), with a strong Rare Earth axial magnetic field.

Test 3

A 1.25 kg bottom ash sample was passed over a drum (drum #3), with a strong Rare Earth radial magnetic field.

Both tests 2 and 3 utilized single step magnetic separation.

The test results are shown in the following table. The table also indicates the splitter position in terms of the distances A and B of the leading edge of the mechanical splitter from the rotational axis of the drum (see FIG. 2) and the drum speed in terms of $min^{-1}$ and surface speed in m/min. Table 1 also indicates the results of the magnetic separation.

| Test | Drum | Feed Rate | Splitter Position | | Drum Speed | | | Sample | Weight | % of Feed |
|---|---|---|---|---|---|---|---|---|---|---|
| No. | Type | (t/hr) | A | B | RPM | M/Min. | Description | No. | (g) | Weight |
| 1 | FA | 1.5 | 125 mm | 140 mm | ~63 | 60 | Feed | 100 | 2498 | |
| | | | | | | | Magnetics 1 | 101 | 716 | 28.7 |
| | | | | | | | Non Magnetics 1 | 102 | 1782 | 71.3 |
| | RA | 1.5 | 70 mm | 160 mm | ~63 | 60 | Magnetics 2 | 103 | 236 | 16.8 |
| | | | | | | | Non Magnetics 2 | 104 | 764 | 54.5 |
| 2 | RA | 1.5 | 70 mm | 160 mm | ~63 | 60 | Feed | | 1248 | |
| | | | | | | | Magnetics 1 | 201 | 593 | 47.5 |
| | | | | | | | Non Magnetics 1 | 202 | 655 | 52.5 |
| 3 | RR | 1.5 | 115 mm | 170 mm | ~63 | 60 | Feed | | 1247 | |
| | | | | | | | Magnetics 1 | 301 | 736 | 59.0 |
| | | | | | | | Non Magnetics 1 | 302 | 511 | 41.0 |

EXAMPLE 3

FIG. 1 shows schematically an embodiment of a system for practicing the invention.

A boiler 6 is fed with fuel (waste) at 7 and rock ilmenite bed material at 8.

Bottom ash is retrieved via 9 and fed to a rotary sieve 10 having a mesh size of 500 μm. The coarse fraction comprising mostly ash and some lost ilmenite material is discarded at 11.

The fine particle size fraction is fed to a magnetic separator 12 comprising a rare earth roll magnet (as shown above). The nonmagnetic fraction from the magnetic separator 12 is discarded at 13. The magnetic fraction is recirculated as bed material (ilmenite) to the boiler at 14.

EXAMPLE 4

This example serves to illustrate material stream calculations in a further embodiment of the invention shown in FIG. 3.

The system of FIG. 3 corresponds to that of FIG. 1 but additionally comprises a classifier 15 wherein the finer particles from the bottom ash are entrained by an airflow and carried back to the boiler.

A bottom ash mass balance, taking into account coarse ash, fine ash, and ilmenite was constructed for the system shown in FIG. 3.

Coarse ash components (A) include large particles that are easily separated by the existing recirculation system and are not accumulated, fine ash components (As) include inert sand and small agglomerates of ash that can be accumulated by the existing recirculation system, the ilmenite (I) can also, of course, be accumulated by the existing recirculation system.

For the purposes of this example, the boiler is a 75 MW municipal solid waste fired boiler with a classifier that operates at 95% separation efficiency for ilmenite and fine ash. The material streams of interest are denoted in FIG. 3. Another material stream, not included in the model, consists of the very fine particles that are carried out of the furnace by the flue gas and separated as fly ash in the flue gas treatment plant, e.g. a bag-house filter or an electrostatic precipitator. This material stream consists of very fine particles from the fuel, very fine particles of fresh bed material and very fine bed material particles formed by attrition in the furnace.

C denotes the classifier 15, B the boiler 6, R the rotary sieve 10, and M the magnetic separator 12. The indexes e and r denotes exiting and returning respectively. The separation efficiencies of the classifier and rotary sieve are assumed to be equal for ilmenite and fine ash while the magnetic separator is described using two different efficiencies for ilmenite and fine ash (optimally 0% for ash). The separation efficiency is varying in relation to the inflow for all separators of the system: classifier, mechanical and magnet. The coarse ash is assumed to pass both the classifier and the mechanical sieve without any fraction of it being separated ($\eta_{C,A}=0$ and $\eta_{R,A}=0$).

The mass balances for ilmenite and fine ash are similar and therefore only that of ilmenite is described as follows:

$$\frac{dm_i}{dt} = I_i + I_{C,r} + I_{M,r} - I_{B,e} \tag{1}$$

$$I_{B,e} = (A_i + I_i + As_i + I_{C,r} + I_{M,r} + As_{C,r} + As_{M,r}) * \frac{m_i}{m_{tot}} \tag{2}$$

$$I_{C,r} = I_{B,e} * \eta_C \tag{3}$$

$$I_{C,e} = I_{B,e} - I_{C,r} \tag{4}$$

$$I_{R,r} = I_{C,e} * \eta_R \tag{5}$$

$$I_{R,e} = I_{C,e} - I_{R,r} \tag{6}$$

$$I_{M,r} = I_{R,r} * \eta_{M,I} \tag{7}$$

$$I_{M,e} = I_{R,r} - I_{M,r} \tag{8}$$

where $m_i$ denotes the mass of ilmenite inside the boiler and $m_{tot}$ is the total mass of the bed inventory, including the coarse ash ($m_A$) and the fine ash $m_{As}$). At steady state the transient term dmi/dt is equal to zero.

Upon deriving a matching set of equations for the fine ash (As), the system is calculated to yield the fraction of ilmenite in the boiler, eqn. (9), and the average time that the ilmenite spends inside the system (identical to the average residence time of the ilmenite particles in the boiler ($T_{Res,ilmenite}$) as defined above), eqn. (10).

$$F_i = \frac{m_i}{m_{tot}} \tag{9}$$

$$\tau_i = \frac{m_t}{I_i} \tag{10}$$

Four cases are defined:

1) The base case, with only the classifier as separator.
2) Also mechanical sieve and magnetic separator. Same addition rate of fresh ilmenite.
3) Also mechanical sieve and magnetic separator. Reduced flow of added fresh ilmenite, so that it gives the same fraction of ilmenite in the bed as in the base case.
4) Also mechanical sieve and magnetic separator. Increased efficiency of the mechanical and magnetic separator.

Cases 1) to 3) are comparative examples, case 4) is according to the invention. The mass flow data are typical values measured over long time in the particular boiler, Table 2.

In case 4, it is utilized the superior attrition resistance (less accumulated attrition rate, see below) of rock ilmenite compared with sand ilmenite by applying a recovery system with a higher efficiency (η), as seen from the data in Table 2. This case is applicable at ilmenite residence time exceeding around 7 days (168 h).

TABLE 2

Input data for the four cases.

| | Case | | | |
|---|---|---|---|---|
| | 1 | 2 | 3 | 4 |
| | Comment | | | |
| | Base case | The same ilmenite fraction in the bed | Decreased ilmenite addition | Invention using rock ilmenite |
| Mass flows (kg/s) | | | | |
| $I_i$ | 225 | 225 | 81 | 56 |
| $A_{Si}$ | 1000 | 1000 | 1000 | 1000 |
| $A_i$ | 4000 | 4000 | 4000 | 4000 |
| Bed inventory, $m_{tot}$ (kg) | 25000 | 25000 | 25000 | 25000 |
| Separation efficiencies (—) | | | | |
| $\eta_c$ | 0.95 | 0.95 | 0.95 | 0.95 |
| $\eta_R$ | 0 | 0.8 | 0.8 | 0.96 |
| $\eta_{Mi}$ | 0 | 0.8 | 0.8 | 0.96 |
| $\eta_{MAs}$ | 0 | 0 | 0 | 0 |

The calculated data, Table 3, describe the fraction of ilmenite in the boiler, the average residence time of ilmenite within the system (including the effects of recirculation), and the possible reduction in the amount of introduced ilmenite that maintains the ilmenite fraction of the base case.

TABLE 3

Derived data for the base case and for operation with the proposed system.

| Case | 1 | 2 | 3 | 4 |
|---|---|---|---|---|
| Fraction of ilmenite in the bed [%] | 15.8 | 34.2 | 15.8 | 37.4 |
| Average residence time of ilmenite in the system [h] | 17.5 | 38.0 | 48.7 | 166 |
| Possible reduction in ilmenite feed [kg/h] (% of case 1) | | | 144 (64) | 169 (75) |

EXAMPLE 5

This example compares the composition of sand ilmenite (not according to the invention) and rock ilmenite.

Sand ilmenite, which originated from Australia, was provided by Sibelco, while rock ilmenite originated from Norway and was provided by Titania A/S. The elemental composition of the fresh materials are presented in Table 4, with the main crystal phase identified being $FeTiO_3$.

TABLE 4

Elemental specification of sand and rock ilmenite as-received from supplier

| Element | Sand Ilmenite wt. % | Rock Ilmenite wt. % |
|---|---|---|
| Fe | 34.20 | 33.29 |
| Ti | 27.93 | 23.85 |
| Mg | 0.44 | 1.83 |
| Si | 0.15 | 0.94 |
| Al | 0.19 | 0.34 |
| Mn | 0.48 | 0.13 |
| Ca | 0.06 | 0.26 |
| K | 0.07 | 0.07 |
| Na | 0.04 | 0.08 |
| P | >0.01 | >0.01 |

EXAMPLE 6

This example examines the attrition properties of sand ilmenite (shape factor 0.91) and rock ilmenite (shape factor 0.7). Sand ilmenite is a comparative example, both sand and rock ilmenite are those from example 5.

The tests were carried out in a 12 $MW_{th}$ CFB-boiler situated in the Chalmers university campus predominantly used for district heating of campus facilities from November to April. The furnace has a cross section of 2.25 $m^2$ and a height of 13.6 m. A detailed description of the system is provided in Thunman, H. Lind, F. Breitholtz, C. Berguerand, N. Seemann, M. 2013; Using an oxygen-carrier as bed material for combustion of biomass in a 12-$MW_{th}$ circulating fluidized-bed boiler; Fuel 113, 300-309.

The system is equipped with a number of extraction ports where bed material and bottom ashes can be extracted at the dense state of the bed using a water-cooled suction probe. Bed material samples were extracted from the dense bed, the first one shortly after start-up and then on a daily basis for 15 days. In the present paper, only the results from the second and $15^{th}$ days are presented. During the experimental period, controlled amount of new bed material was added when required in order to keep constant operational conditions.

Two experimental runs have been performed, one with each of sand and rock ilmenite. For both of the experimental sessions 100% of the respective ilmenite was used in the boiler as bed material. During the experiments, the boiler was fired with wood-chips that had a moisture content in the range of 38.5-45.3 wt. % based on the as-received fuel and the bed temperature was held around 850° C. Furthermore, to withhold stable operational conditions, the bed height was held constant through continuous supply of additional fresh material. The total bed inventory in the boiler was held around 3000 kg throughout the experiments.

A selection of the extracted bed material samples were immobilized in epoxy resin and polished to obtain a cross-sectional surface of the particles, which was evaluated with Scanning Electron Microscopy (SEM) analysis. Quanta 200FEG equipped with an Oxford EDS system was used for SEM imaging and elemental composition analysis. 50-60 g of the sampled bed material was sieved during 20 min to obtain the size distribution. Sieving plates of the following mesh size was used; 355 μm, 250 μm, 180 μm, 125 μm, 90 μm and a bottom plate for fractions below 90 μm. Particles in the range of 125-180 μm were collected during the sieving, from which a sample of 5 g was tested for mechanical stability in a customized jet cup, described in detail in Rydén, M. Moldenhauer, P. Lindqvist, S. Mattisson, M. Lyngfelt, A. 2014; Measuring attrition resistance of oxygen carrier particles for chemical looping combustion with a customized jet cup; Powder Technology 256, 75-86. The apparatus is constructed to simulate the mechanical stress that particles undergo in a FBC. A filter collecting the fine particles that leave the device at the top, was continuously measured, providing the rate of attrition of the bed material particles.

Cross-sectional SEM micrographs of fresh sand and rock ilmenite particles are shown in FIGS. 4*a*) and *b*), respectively. The materials differ in particle morphology where the sand ilmenite particles have rounded edges and the rock ilmenite particles have sharp edges. The shape factors are 0.91 and 0.7 respectively.

The difference in particle shape is influenced by the origin of the materials. The sand ilmenite, which has been used in the as-received form, has prior to collection been exposed to natural weathering, erosion and attrition, whereof the particles have obtained a rounded shape. This is not the case for rock ilmenite particles which have been mined and ground and are thus sharp-edged. Analysis with SEM-EDX show that both materials have a homogeneous distribution of Fe and Ti over the cross-section with no local enrichment of either of the elements.

The change in morphology of the particles have been followed on samples of both sand and rock ilmenite extracted from the boiler after 2 and 15 days. The cross-sectional micrographs of these are presented in FIG. 5 *a*)-*d*). After 2 days of exposure, (FIG. 5 *a*)), small voids are formed at the outer parts of the sand ilmenite particle. This phenomenon is further developed over time and is more prominent after 15 days (FIG. 5 *b*)) where the voids have evolved to larger cavities that are widespread at the inside of the particles. The rock ilmenite particles have formed distinct cracks that were extended along the inside of the particles, after 2 days (FIG. 5 *c*)). During further exposure, the cracks in the rock ilmenite expanded further, which led to break-up of the majority of the particles (FIG. 5 *d*).

The different morphologies developed during exposure points on the importance that the initial structural morphology of the particles have on their mechanical performance during exposure. Small cavities are expected to form within the bed material particles, as a result of inter-diffusion of elements during high temperature exposure. Further, formation of cracks has also been reported previously as a result of the thermal and mechanical stress that the particles undergo within the reactor (Knutsson, P. Linderholm, C. 2015; Characterization of ilmenite used as oxygen carrier in a 100 kW chemical-looping combustor for solid fuels; Applied Energy 157, 368-373). During the mining and the grinding process that the rock ilmenite has undergone prior to exposure, the material has accumulated mechanical stress. The further thermal and chemical stress during exposure to the conditions in the combustion chamber, adds to this accumulated stress and leads, most probably, to cracks opening as a form of stress release. The initial material preparation, could therewith be used as an explanation for the mechanism observed for the rock ilmenite.

Particle size distributions have been obtained through sieving of the materials prior to exposure as well as sieving the collected samples that have been used in the boiler. In FIG. 6, the results from the sieving of fresh sand and rock ilmenite, as well as the materials collected after 2 and 15 days, are presented. R stands for rock, S for sand, F for fresh material, 2 and 15 are the amount of days that the material has been used as bed material before extraction. The sieving curves of the fresh materials reveal that the sand ilmenite contains considerably higher amount of finer fractions than the rock ilmenite, which is in line with the supplier's specifications. The lower amount of fines in the case of rock ilmenite, can be explained with the more narrowed size distribution that is obtained through grinding.

After 2 days of exposure the rock ilmenite shows a noticeable increase in the amount of coarse particles (particles above 250 μm), which further expands with time. This trend is accompanied by an initial decrease in the finer particle fractions (below 125 μm), followed by a moderate increase after 15 days. For the sand ilmenite, a drastic decrease of finer fractions can be observed after two days, as well as a significant increase of particles over 180 μm. These trends are consistent and sustained after 15 days.

The enlargement of particle size for both sand and rock ilmenite, with increased time in the combustion chamber, can be explained by the ash layer growth around the particles. Increase in the porosity of the ilmenite particles (both sand and rock) has also been observed and previously reported, which would also lead to increase in the size of the bed material particles. The drastic decrease of finer fractions could mainly be explained by particle loss due to their entrainment with the flue gases and with the fly ash. Some of the particles are also expected to increase in size due to the factors described previously and thereby be accounted for in higher size fractions within the sieving curve.

FIG. 7 shows the results of the attrition tests performed on both sand, S (solid lines) and rock, R (dashed lines) ilmenite in "as-received" conditions and after 2 and 15 days of exposure. Diamond markers represent fresh material, F, square and circular markers represent material that has been extracted after 2 and 15 days of operation in the combustor, respectively.

FIG. 8 plots the rightmost data points from FIG. 7 against residence time in the boiler for sand and rock ilmenite.

The fresh materials are worn equally in the beginning, followed by a slight increase in the measured attrition for the case of fresh rock ilmenite. The increase in the latter case was expected due to the observed sharp edged particles morphology which is thus more easily worn off than the rounded structure of the fresh sand ilmenite particles. Accordingly, used rock ilmenite particles obtain a more rounded shape with exposure time in the combustion chamber, which is also confirmed by the results in FIG. 5. For both materials, the measured attrition is increased after exposure in the boiler. The materials show higher attrition after 2 days than after 15 days of exposure. The highest accumulated attrition is found for the rock ilmenite after 2 days, which with further exposure decreases below the attrition for the exposed sand ilmenite samples.

The attrition of both materials is highest after 2 days, which is reasonably due to that the inherent stress in the particles is released early in their exposure to boiler conditions. This is confirmed by the observation that the attrition is higher for the rock ilmenite which in its as-received form is also expected to contain a higher degree of inherent stress. With further exposure, the attrition of both materials is decreased. The reason for this could be coupled to that the particles are stabilized by the formation of ash layers. However, the rock ilmenite becomes considerably more resistant to mechanical stress with time in comparison to sand ilmenite. The reason being that cavities found in sand ilmenite are built up over time while the cracks in the rock ilmenite are formed earlier on.

The obtained results point to that the sand and rock ilmenite differ in their structural development, which has impact on their corresponding mechanical stability. It is found that rock ilmenite is initially less resistant to mechanical stress, but with increased exposure becomes more resistant to it in comparison to sand ilmenite.

The invention claimed is:

1. A method for operating a fluidized bed boiler (6), comprising the steps of:

a) providing fresh rock ilmenite particles having a shape factor of 0.75 or lower as bed material to the fluidized bed boiler (6);

b) carrying out a fluidized bed combustion process;

c) removing at least one ash stream comprising ilmenite particles from the fluidized bed boiler;

d) separating ilmenite particles from the at least one ash stream, wherein the separation includes a step of using a magnetic separator (12) comprising a rare earth roll or rare earth drum magnet and a field strength of 2,000 Gauss or more, wherein the separation efficiency of step d) is at least 0.5 by mass for ilmenite, and wherein the separation is at least one of a one-stage magnetic separation including an axial or radial magnetic field, and a two-stage magnetic separation with a first step using an axial magnetic field and a second step using a radial magnetic field;

e) recirculating separated ilmenite particles into the bed of the fluidized bed boiler;

the method further comprises a pre-classification step, in which the particles in the at least one ash stream are pre-classified before magnetic separation of the ilmenite particles from the ash stream, wherein the pre-classification comprises mechanical particle classification comprising sieving with a mesh size from 200 to 1,000 μm, wherein the average residence time of ilmenite particles in the fluidized bed is 100 h or more.

2. The method of claim 1, characterized in that the fresh ilmenite particles comprise a particle size distribution with a maximum at 100 to 400 μm.

3. The method of claim 1, characterized in that the at least one ash stream is selected from the group consisting of bottom ash stream and fly ash stream.

4. The method of claim 1, characterized in that the pre-classification further comprises fluid driven particle classification.

5. The method of claim 4, characterized in that the mechanical particle classification comprises sieving with a mesh size from 300 to 800 μm.

6. The method of claim 1, characterized in that the separation includes a step of using a magnetic separator (12) comprising a field strength of 4,500 Gauss or more.

7. The method of claim 1, characterized in that the average residence time of the ilmenite particles in the fluidized bed boiler (6) is at least 120 h.

8. The method of claim 1, characterized in that the average residence time of the ilmenite particles in the fluidized bed boiler (6) is less than 600 h.

9. The method of claim 1, characterized in that the boiler (6) is a circulating fluidized bed boiler (CFB).

10. The method of claim 1, characterized in that the separation efficiency of step d) is at least 0.7 by mass for ilmenite.

11. The method of claim 1, characterized in that the fraction of ilmenite in the bed material is 25 wt. % or more.

12. The method of claim 2, characterized in that the fresh ilmenite particles comprise a particle size distribution with a maximum at 150 to 300 μm.

13. The method of claim 4, characterized in that the pre-classification further comprises gas driven particle classification.

14. The method of claim 5, characterized in that the mechanical particle classification comprises sieving with a mesh size from 400 to 600 μm.

15. The method of claim 5, characterized in that the mechanical particle classification uses a rotary sieve.

16. The method of claim 7, characterized in that the average residence time of the ilmenite particles in the fluidized bed boiler (6) is at least 200 h.

17. The method of claim 16, characterized in that the average residence time of the ilmenite particles in the fluidized bed boiler (6) is at least 300 h.

18. The method of claim 8, characterized in that the average residence time of the ilmenite particles in the fluidized bed boiler (6) is less than 500 h.

19. The method of claim 18, characterized in that the average residence time of the ilmenite particles in the fluidized bed boiler (6) is less than 400 h.

20. The method of claim 19, characterized in that the average residence time of the ilmenite particles in the fluidized bed boiler (6) is less than 350 h.

21. The method of claim 11, characterized in that the fraction of ilmenite in the bed material is 30 wt. % or more.

* * * * *